US008353618B1

(12) United States Patent
Baker

(10) Patent No.: US 8,353,618 B1
(45) Date of Patent: Jan. 15, 2013

(54) EXTERNAL VIBRATORY GROUT CONSOLIDATOR FOR VERTICALLY REINFORCED CONCRETE MASONRY

(76) Inventor: Robert Allan Baker, Kalispell, MT (US)

( * ) Notice: Subject to any disclaimer, the term of this patent is extended or adjusted under 35 U.S.C. 154(b) by 0 days.

(21) Appl. No.: 13/338,903

(22) Filed: Dec. 28, 2011

Related U.S. Application Data

(62) Division of application No. 12/322,754, filed on Feb. 6, 2009, now Pat. No. 8,092,071.

(60) Provisional application No. 61/065,092, filed on Feb. 8, 2008.

(51) Int. Cl.
*B01F 11/00* (2006.01)

(52) U.S. Cl. ..... 366/2; 366/120; 366/123

(58) Field of Classification Search ..... 366/2, 120, 366/123; 81/370
See application file for complete search history.

(56) References Cited

U.S. PATENT DOCUMENTS

| | | | | |
|---|---|---|---|---|
| 1,865,652 | A * | 7/1932 | Upson | 405/239 |
| 2,063,924 | A * | 12/1936 | Hanko | 248/229.23 |
| 2,489,895 | A * | 11/1949 | Kash | 81/370 |
| 2,522,906 | A * | 9/1950 | Smith | 211/1.51 |
| 6,960,011 | B2 * | 11/2005 | Oswald et al. | 366/108 |
| 7,806,583 | B2 * | 10/2010 | Oswald | 366/123 |
| 8,092,071 | B1 * | 1/2012 | Baker | 366/120 |
| 2003/0111753 | A1 * | 6/2003 | Oswald et al. | 264/35 |
| 2007/0195639 | A1 * | 8/2007 | Oswald | 366/123 |

* cited by examiner

*Primary Examiner* — David Sorkin
(74) *Attorney, Agent, or Firm* — Goldstein Law Offices, P.C.

(57) ABSTRACT

A vibratory grout consolidator for eliminating gaps and voids in grout by attaching to reinforcing bars extending within masonry block walls and encapsulated within the grout. The device includes a clamp including a bar sleeve having a first part attached to a first arm and a second part attached to a second arm. The bar sleeve has a pair of open ends that allow a reinforcing bar to extending fully through the bar sleeve. A vibration source is attached to the clamp so that when the bar sleeve is engaged with the reinforcing bar, vibration is transmitted to the reinforcing bar and encapsulating grout.

14 Claims, 7 Drawing Sheets

EXTERNAL VIBRATORY GROUT CONSOLIDATOR FOR VERTICALLY REINFORCED CONCRETE MASONRY

CROSS REFERENCES AND RELATED SUBJECT MATTER

This application is a divisional of patent application Ser. No. 12/322,754, filed in the United States Patent Office on Feb. 6, 2009 now U.S. Pat. No. 8,092,071, which is a non-provisional of provisional patent application Ser. No. 61/065/092, filed in the United States Patent Office on Feb. 8, 2008.

BACKGROUND OF THE INVENTION

The invention relates to a vibratory grout consolidator. More particularly, the invention relates to a system for attaching a vibratory device to vertical reinforcing bars within a masonry installation, for vibrating grout contained therein to eliminate air spaces and voids.

Concrete is not only the most widely used building material, but it is the most widely used man-made material on the planet. Among other things, concrete is used to make pavements, foundations, roads, overpasses, parking structures, brick/block walls, and footings for gates, fences, and poles. Perhaps the best reason for its popularity is that it is initially highly formable. Then after hardening through hydration, it has similar physical properties to stone.

In its original semi-plastic state, concrete can be poured into a form of almost any shape, and will generally fill every corner and contour to take the shape of the form. The ability of concrete to flow into a form and fill its shape is known as its "workability". Often, the presence of large aggregate, and other factors will lower its workability. As a consequence, the concrete will sometimes leave unfilled spaces (voids), and air gaps. Once the concrete hardens, these spaces can weaken the concrete, and make it vulnerable to water infiltration and subsequent freezing and cracking.

Vertically reinforced concrete masonry walls are constructed of blocks which have vertically extending cavities known as "cells". The blocks are stacked using mortar—like other conventional block walls. In addition, the blocks are reinforced by placing rebar (reinforcement bar) or other bars composed of structural grade materials through the vertically aligned cells of the blocks and then filling the cavities about the bars with grout.

When constructing reinforced masonry walls, then, grout serves an important purpose such that it embeds the rebar that extends vertically within the otherwise hollow masonry blocks. The grout material used for such purposes is essentially concrete, yet often employs smaller sized aggregate.

Vertically Reinforced masonry wall installations are quite vulnerable to workability problems when they are filled with grout. The grout is critical, because it bonds the reinforcement bars to the masonry blocks so that they can act together to resist loads. The scale of the cavities being filled within the blocks, blockages due to mortar joints between blocks, and imperfect alignment between cells as the blocks are stacked, however, provide many opportunities for the creation of voids within the grout. At the same time, such voids can be disastrous when they fail to adequately encapsulate the rebar within the grout. In addition, the presence of a void around a reinforcement bar provides an opportunity for water to collect and exacerbate rust.

It is common practice to vibrate concrete after it is poured, to agitate the slurry so that it removes air and voids while the mixture is still wet. This is often done with a vibrator, which carries an eccentric weight that causes vibrations as it rotates. When the vibrator is immersed within the wet concrete it consolidates the concrete into open spaces and provides pathways for air to escape.

Over the course of many years, various devices have been proposed for vibrating concrete. For example, back in 1929, U.S. Pat. No. 1,770,154 was filed, demonstrating how vibrators were used to eliminate voids and air pockets in forming a reinforced concrete construction having superior strength.

U.S. Pat. No. 6,155,708 to Lindley discloses a concrete vibrator with an offset rotor. Lindley, however, is designed to be immersed in concrete.

United States Patent Application Publication No. 2005/0276156 by Elsten discloses a hand held concrete vibrator that is attached to a common hand drill. Elsten, however, is intended for contacting the outside surface of a wall, and is not suitable for directly vibrating rebar.

U.S. Pat. No. 6,960,011 to Oswald et al. discloses a vibrator for receiving the protruding end of a rebar rod or grid. Unfortunately, Oswald is only suited for attaching over the end of a bar. It cannot be attached at other points on the bar.

While these units may be suitable for the particular purpose employed, or for general use, they would not be as suitable for the purposes of the present invention as disclosed hereafter.

SUMMARY OF THE INVENTION

It is an object of the disclosure to produce a system capable of consolidating wet grout by removing voids and air pockets therein. Accordingly the present system involves securing a vibrational device that agitates the wet concrete to encourage the removal of voids and air pockets.

It is another object of the disclosure to provide a system that directly contacts rebar structures so as to ensure consolidation around the rebar and thereby ensure an effective bond between the rebar and concrete. Accordingly, the device clamps directly to a reinforcement bar, and is switched on to directly communicates vibrational forces to the bar.

It is a further object of the disclosure to provide a system that can be attached to any part of a reinforcement bar. Accordingly, the device has a clamp with two open ends that allow the bar to extend fully therethrough. This allows the device to be clamped to the rebar at a location close to the wet concrete and allows it to be used on rebar that is hooked, bent, or formed into a rebar cage. In addition, the clamp is elongated, allowing it to reach remote spaces for directly contacting the desired work area.

Disclosed herein is a vibratory grout consolidator for eliminating gaps and voids in grout by attaching to reinforcing bars extending within masonry block walls and encapsulated within the grout. The device includes a clamp including a bar sleeve having a first part attached to a first arm and a second part attached to a second arm. The bar sleeve has a pair of open ends that allow a reinforcing bar to extending fully through the bar sleeve. A vibration source is attached to the clamp so that when the bar sleeve is engaged with the reinforcing bar, vibration is transmitted to the reinforcing bar and encapsulating grout.

To the accomplishment of the above and related objects the device employed in the current system may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
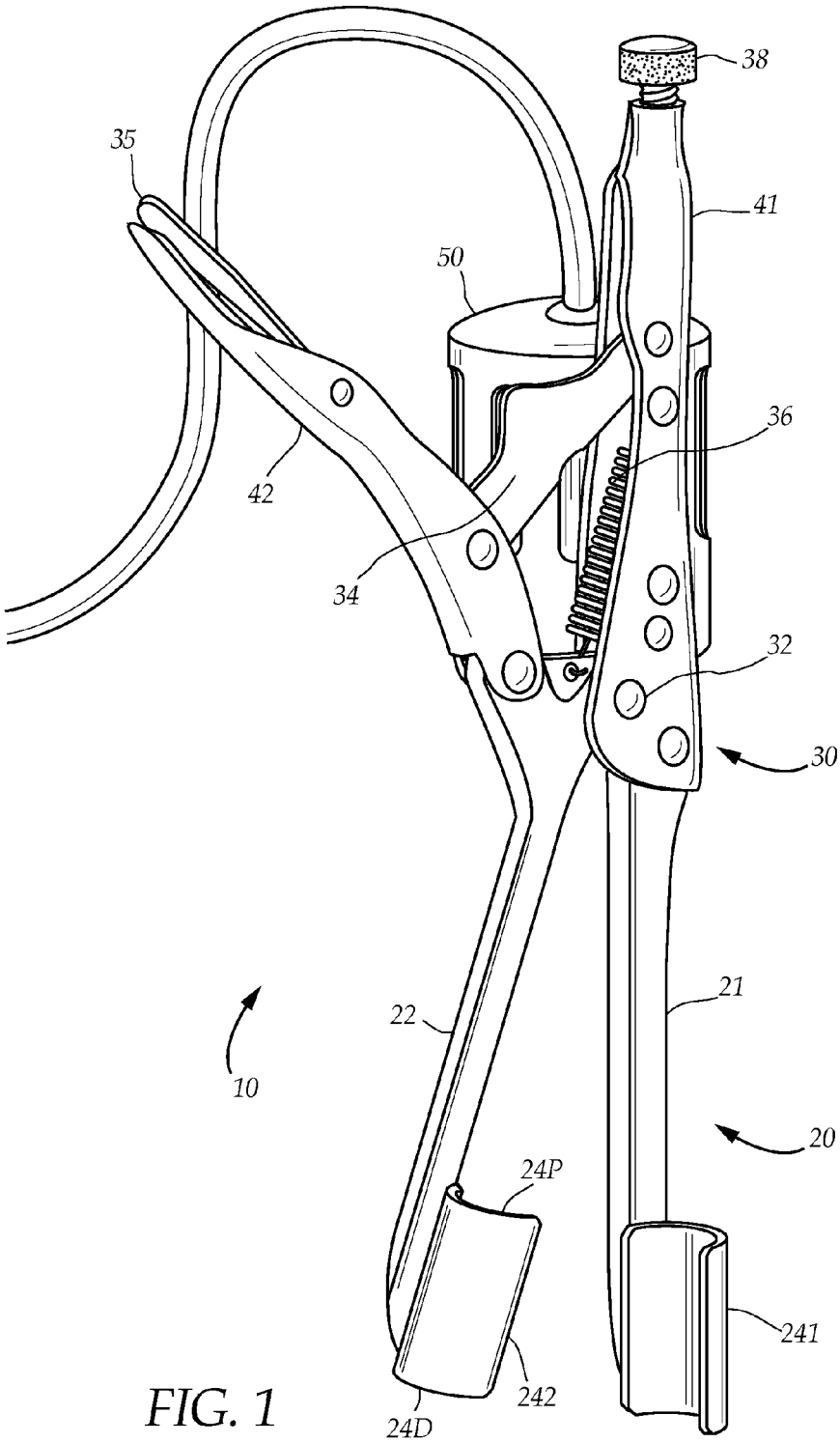
FIG. 1 is a diagrammatic perspective view illustrating a first embodiment, in an open position.
Figure 2:
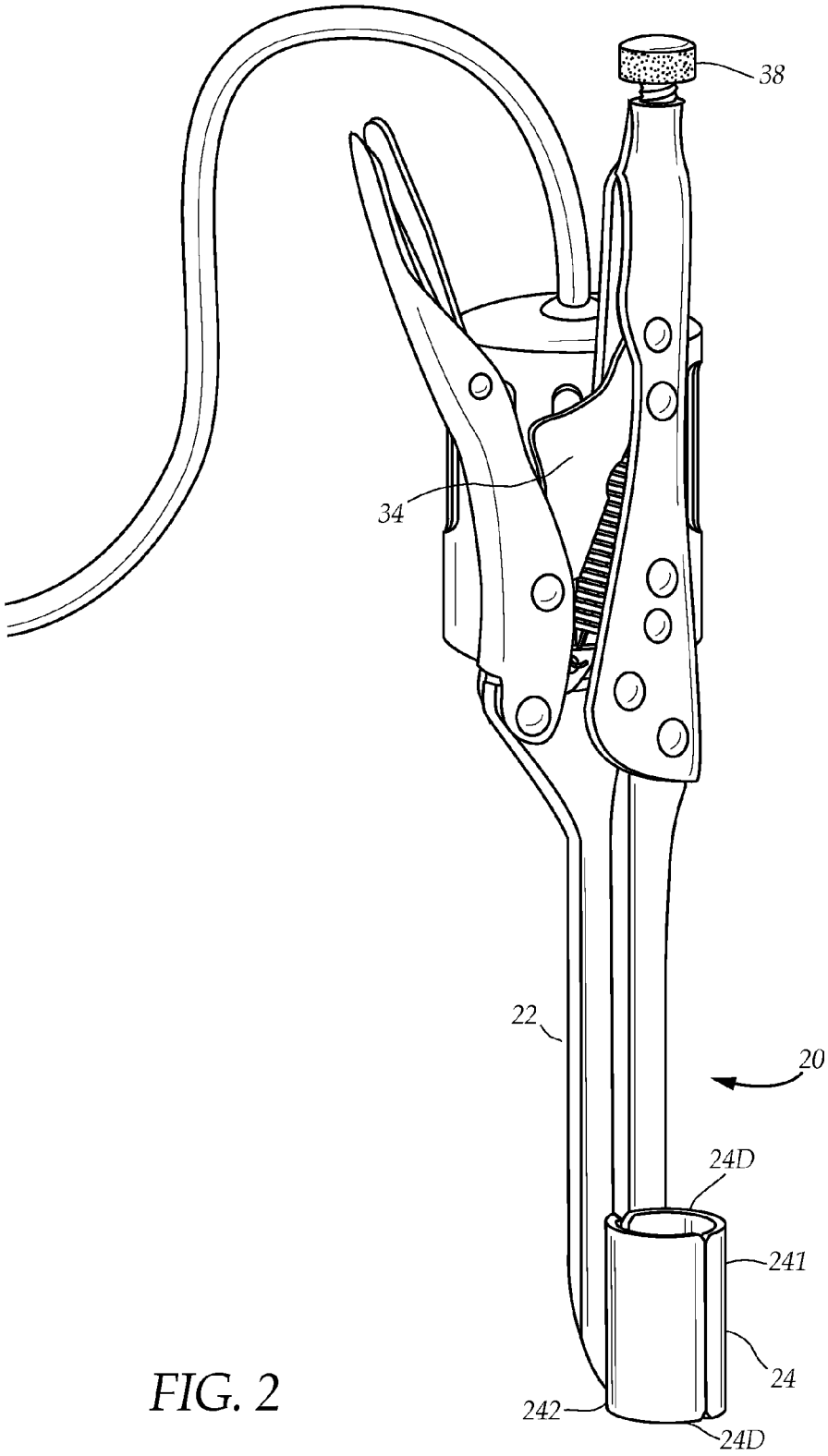
FIG. 2 is a diagrammatic perspective view, illustrating the device in a closed position.

FIG. 1 and FIG. 2 illustrate a vibratory grout consolidator device 10 having a clamp 20, a clamping mechanism 30, and a vibration source 50.

The clamp 20 includes a first arm 21, a second arm 22, and a bar sleeve 24 having a first part 241 and a second part 242. The first part 241 and second part 242 are each arcuate, together forming a cylindrical tube having a proximal end 24P and a distal end 24D (see FIG. 2). The first part 241 and second part 242 are open at both the proximal end 24P and distal end 24D. Accordingly, the clamp 20 can attach onto a cylindrical object and have it protrude beyond both opposite ends of the bar sleeve 24. The clamp 20 has an open position, shown in FIG. 1, wherein the first part 241 and second part 242 are disengaged from each other, and a closed position, shown in FIG. 2, wherein the first part 241 and second part 242 are engaged with each other.

The clamping mechanism 30 is connected to the first arm 21 and second arm 22 of the clamp, and provides a means for opening and closing the clamp. In the embodiment shown in FIGS. 1 and 2, the clamping mechanism 30 is a vice grip, having a first handle 41, rigidly attached to the first arm 21, a second handle 42 pivotally attached to the second arm 22, and a main pivot point 32 at which first arm and second arm are pivotally attached. The vice grip also has a connecting arm 34 attached between the first handle 41 and second handle 42 for adjusting the distance between the first arm 21 and second arm 22 and for urging the clamp into the open position. A release bar 35, attached to the second handle 42, urges the second arm 22 to open the clamp 20. A spring 36 is connected between the first handle 41 and second handle 42. A threaded adjustment rod 38 is located coaxially with the first handle 41, and rotates to allow the clamp 20 to be adjusted. Referring to FIG. 2, clamp 20 is shown in a closed position. The adjustment rod 38 allows the clamp to be adjusted, by moving the connecting arm 34 proximally or distally. The adjustment rod 38 (and vice grip mechanism) allows the first arm 21 and second arm 22 to remain substantially parallel to each other, while adjusting the distance between them. Accordingly, the size of the bar sleeve 24 when closed can be adjusted. It can be made wider to accommodate larger rebar, or smaller, as appropriate.

Figure 3:
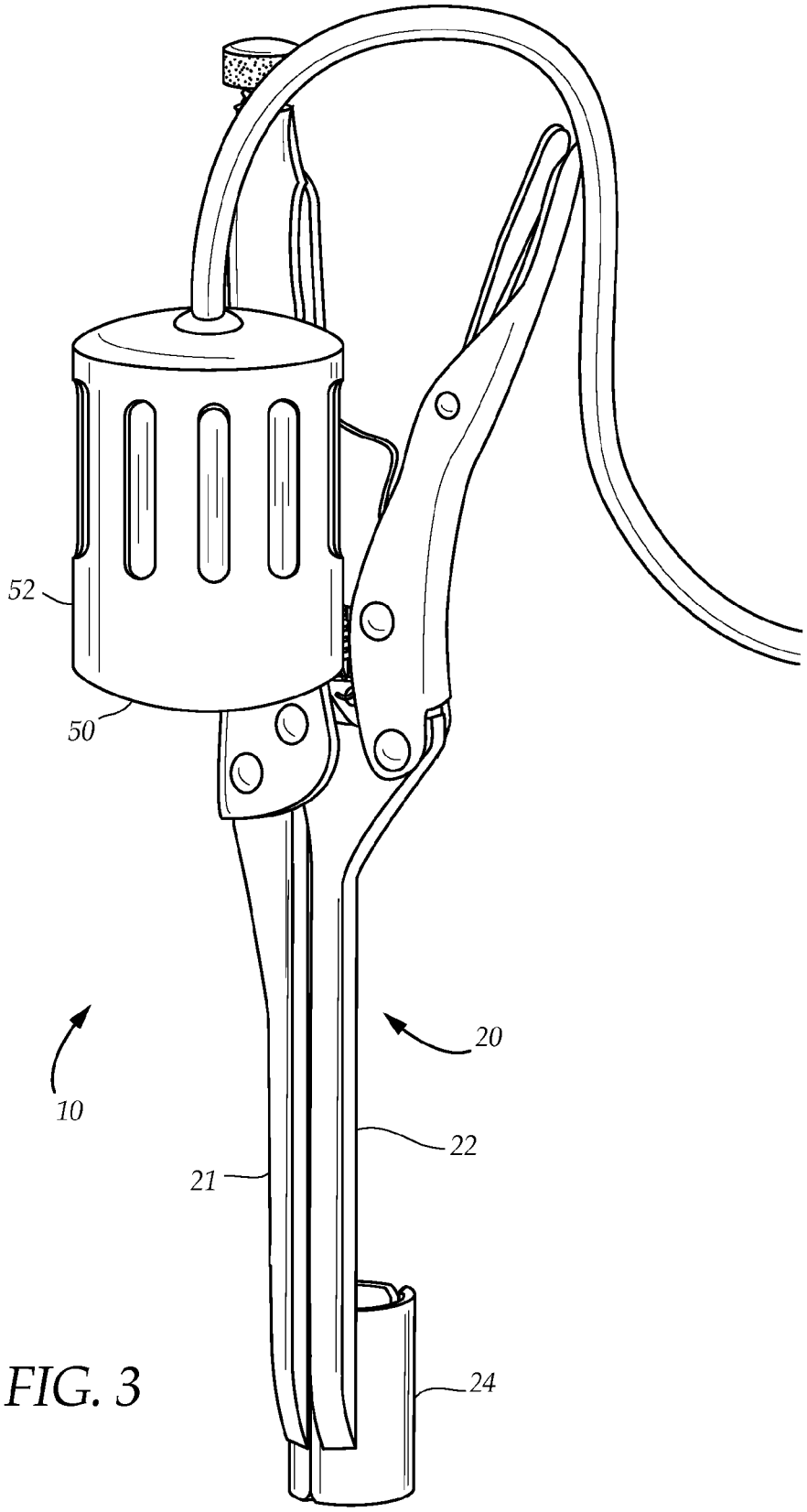
FIG. 3 is a diagrammatic perspective view, illustrating the motor housing of the device.

FIG. 3 illustrates the vibration source 50 attached to the clamp 20. As would be appreciated by those skilled in the art, the production of vibration can be accomplished in a variety of ways. The vibration source 50 includes a motor housing 52. The motor housing 52 contains a motor and an eccentric weight. The rotation of the eccentric weight causes the motor housing 52 to go slightly off balance. With increasing speed, the rotation of the eccentric weight causes the motor housing 52 to wobble, and then vibrate. The physical connection of vibration source 50 to the clamp 20—through metallic components—allows the vibration to easily transmit to and through the clamp 20, such that it is present at the bar sleeve 24. Note that the arms 21, 22 are elongated, allowing the bar sleeve 24 to be a significant distance from the vibration source 50. Accordingly, the device 10 can be engaged with a target work area, such as within a masonry block, that is narrow or "hard to reach", without the need maneuver the vibration source 50 into the block or other narrow space. This advantage will be apparent in view of the following example uses.

Figure 4:
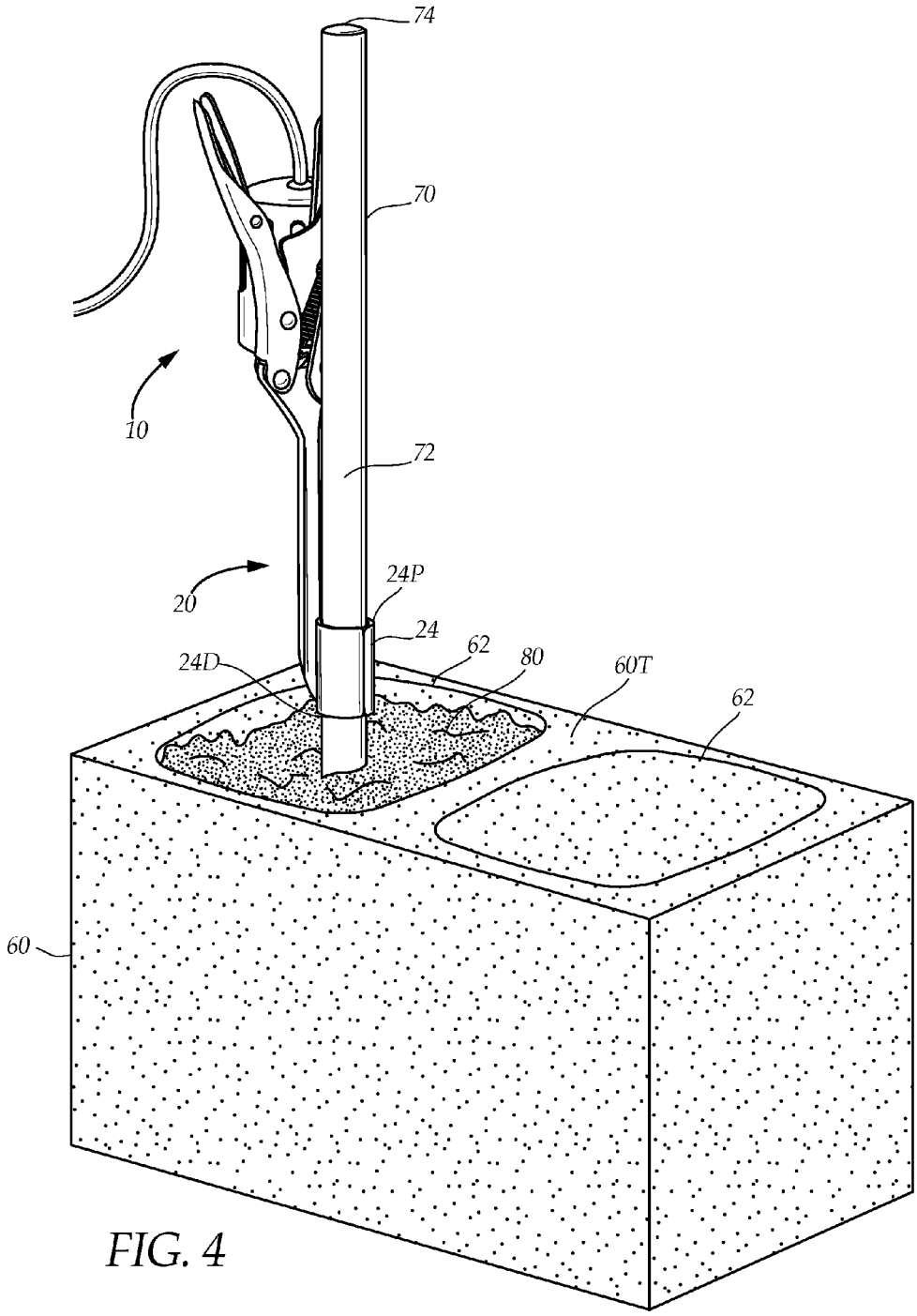
FIG. 4 is a diagrammatic perspective view, illustrating the device attached to a reinforcement bar extending vertically from a cell of a masonry block that is filled with grout.

FIG. 4 illustrates a masonry block 60, having a top 60T, and a pair of cells 62 extending downwardly from the top 60T. A vertical reinforcement bar 70 having a cylindrical side wall 72, and a pair of ends 74, extends downwardly through one of the cells 62. One of the ends 74 is submerged beneath the top of the block 60T. The reinforcement bar 70 is encapsulated in grout 80, such that the cell 62 having the reinforcement bar 70 is filled with grout 80 substantially to the top 60T of the block 60.

Also illustrated in FIG. 4, the device 10 has been attached to the reinforcement bar 70. In particular, the clamp 20 is fully engaged with the cylindrical side wall 72 of the reinforcement bar 70 such that the reinforcement bar extends fully through the bar sleeve 24. In particular, the reinforcement bar enters bar sleeve 24 at the distal end 24D and exits at the proximal end 24P, extending well above the entire device 10. Advantageously, the bar sleeve 24 may be placed near the grout 80 so that vibration can be transmitted most directly to the reinforcement bar 70 and the encapsulating grout 80. In addition, the reinforcement bar 70 can extend well above the top 60T of the block—often several feet—while the device 10 can still be effectively used to consolidate the grout 80.

Figure 5:
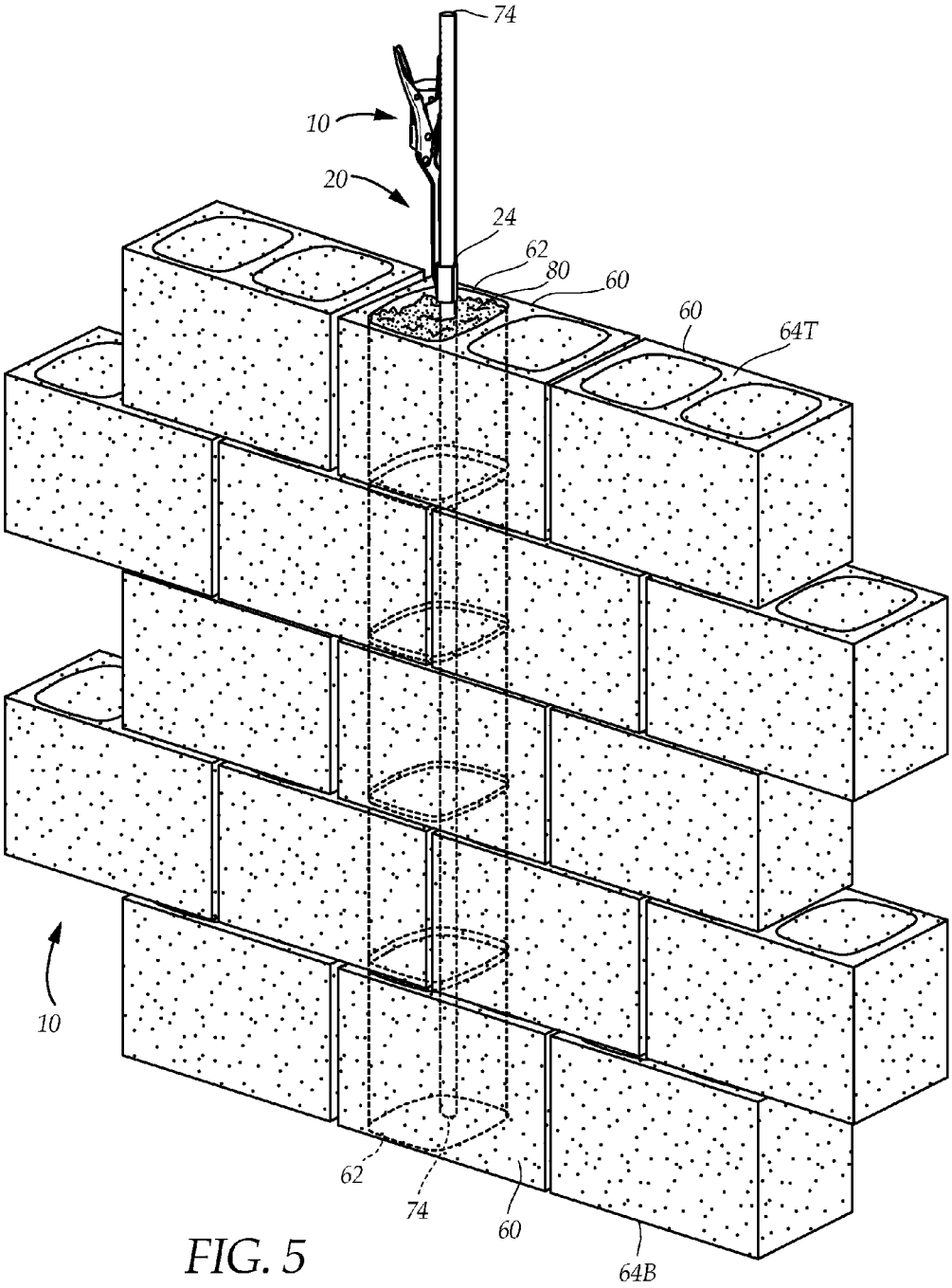
FIG. 5 is a diagrammatic perspective view, illustrating the device attached to the reinforcement bar, as it protrudes from a masonry wall through which it extends.

FIG. 5 presents the use of the device 10 in a larger context, wherein the block 60 is part of a masonry wall 64 having a top 64T and bottom 64B. As illustrated, the masonry wall 64 is made of numerous blocks 60, the blocks 60 each having a pair of cells 62. The cells 62 of the blocks 60 are vertically aligned. The reinforcement bar 70 extends vertically through a set of aligned cells 62 from the bottom 64B to the top 64T of the wall 64, and also extends above the wall 64. The set of aligned cells 62 having the reinforcement bar 70 is filled with grout 80. The device 10 has been attached to the reinforcement bar 70 with the bar sleeve 24 just above the grout 80, which extends to substantially the level of the top 64T of the wall. The device 10 is switched on, transmitting vibration into the reinforcement bar 70 which carries the vibration fully to its ends 74. Accordingly the grout 80 is vibrated by the reinforcement bar 70 causing it to eliminate gaps, air bubbles and voids, and thereby consolidate the grout 80 around the reinforcement bar 70. The device 10 is then switched off and removed from the bar 70 by simply opening the clamp 20.

Figure 6:
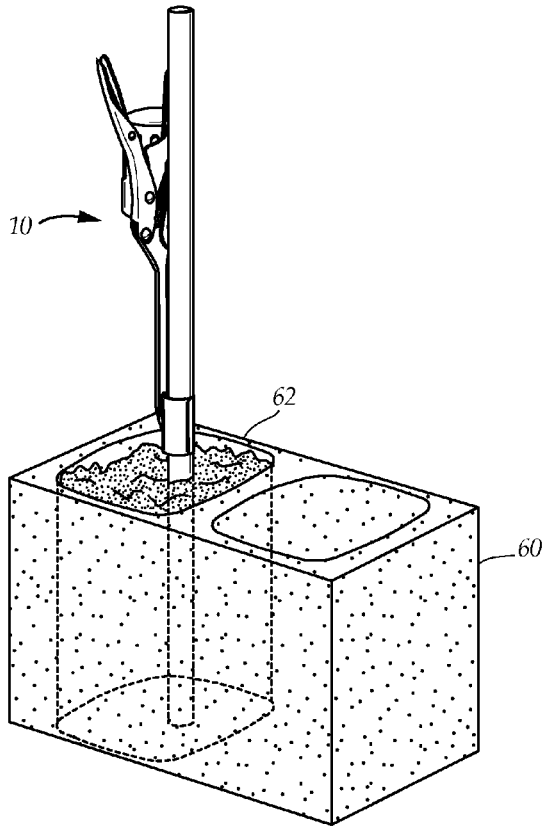
FIG. 6 is a diagrammatic perspective view, similar to FIG. 4, illustrating how vibration travels downwardly into the grout through the reinforcement bar.
Figure 7:
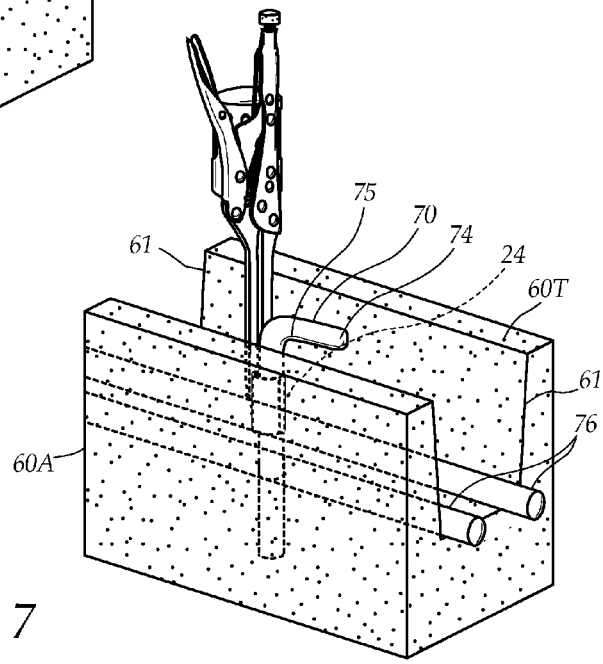
FIG. 7 is a diagrammatic perspective view, illustrating how the device can attach to a reinforcement bar that is bent.

FIG. 6 and FIG. 7 illustrate how the device 10 can be used not only in conjunction with closed side blocks 60 having vertically extending cells 62, but also with lentil blocks 60A, which are also hollow and have a pair of open sides 61. Note that in the installation illustrated in FIG. 7, horizontal reinforcing bars 76 extend through the open sides 61, where they would extend through the open sides 61 of similar lentil blocks. In addition, the reinforcement bar 70 is has a ninety degree bend 75. The bend 75 keeps the reinforcement bar 70 from extending above the top 60T of the block 60A. Note that the device 10 is now submerged below the top 60T of the block, and the bar sleeve 24 is attached to the reinforcement bar between the bend 74 and where the grout would fill the block 60A.

Figure 8:
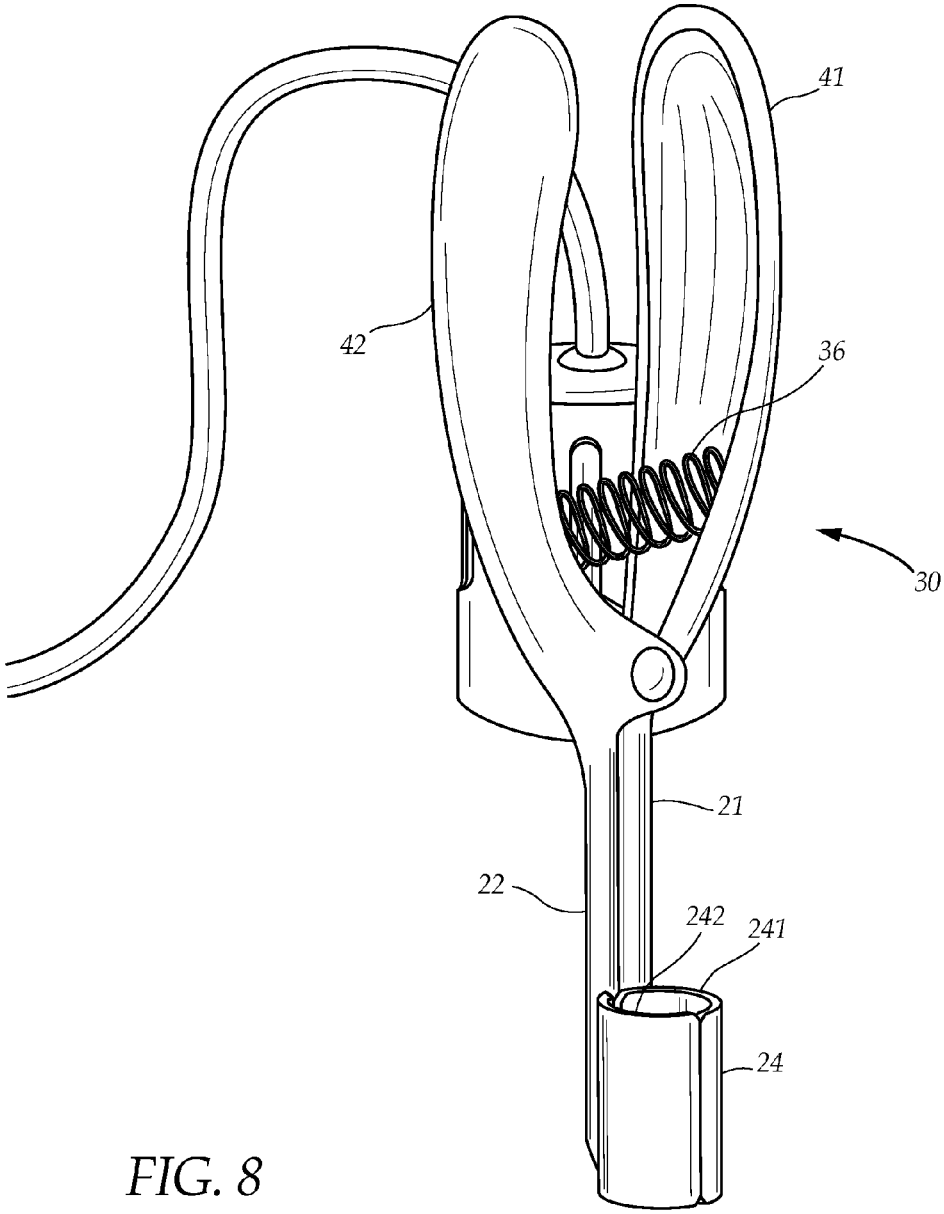
FIG. 8 is a diagrammatic perspective view, illustrating a further embodiment of the device, wherein the clamp is a spring-loaded clamp that is biased toward the closed position.

FIG. 8 illustrates an alternate embodiment for the clamping mechanism 30. In particular, the clamping mechanism is configured like a simple, spring-loaded clamp. In particular, the first handle 41 is connected to the first arm 21, and the second handle 42 is connected to the second arm 22 at the main pivot point. The spring 36 is connected between the first handle 41 and second handle 42 so as to bias the first arm 21 and second arm 22 together, and thus the first part 241 and second part 242 of the bar sleeve 24 together. In use, the first handle 41 and second handle 42 are squeezed together to compress the spring 36 and open the bar sleeve 24. The bar sleeve 24 is engaged with the work surface, and the first handle 41 and second handle 42 are released—causing the spring 36 to expand and hold the first arm 21 against the second arm 22 and thus clamp the bar sleeve 24 onto the desired work surface.

In conclusion, herein is presented a vibratory grout consolidator system. The device used in the system is illustrated by example in the drawing figures, and throughout the written description. It should be understood that numerous variations are possible, while adhering to the inventive concept. Such variations are contemplated as being a part of the present invention.

What is claimed is:

1. A method for consolidating grout within a cell of a masonry block via a reinforcement bar, the bar having a first portion and a second portion, the first portion extending vertically through the cell, the second portion extending above the block outside the cell, the method comprising:

handling a device including a clamp and a vibration source, the clamp for engaging the second portion, the clamp coupled to the source, the clamp including a cylinder defined by a first wall and a second wall, the cylinder having a first open end and a second open end, the cylinder operative to receive the second portion such that the second portion extends through the cylinder along the walls to protrude from both of the open ends, the clamp including a spring and a first arm pivotally attached to a second arm, the spring coupled to the first arm and the second arm, the first arm coupled to the first wall and the second arm coupled to the second wall, the clamp having an open position and a closed position, the clamp including a clamping mechanism coupled to the first arm and the second arm, the clamping mechanism operative to open the clamp to the open position and close the clamp to the closed position, the source operative to selectively produce vibration for communication through the cylinder from the second portion to the first portion, the vibration for consolidating the grout surrounding the first portion within the cell to substantially eliminate gaps and voids therein;

securing the clamp to the second portion such that the second portion extends through the cylinder along the walls to protrude from both of the open ends; and activating the source to vibrate the second portion via the cylinder for consolidating the grout surrounding the first portion.

2. The method of claim 1, wherein the securing comprising opening the clamp into the open position and then closing the clamp into the closed position around the second portion.

3. The method of claim 1, wherein the securing comprising biasing the first arm and second arm together.

4. The method of claim 1, wherein the clamping mechanism comprising a first handle coupled to the first arm, a second handle pivotally coupled to the second arm and a main pivot point at which the first arm and second arm are pivotally coupled, the securing comprising pivoting the first arm with respect to the second arm at the main pivot point.

5. The method of claim 4, wherein the device having a connecting arm coupled between the first handle and second handle for adjusting a distance between the first arm and second arm and for urging the clamp into the open position.

6. The method of claim 5, further comprising urging the second handle to open using a release bar, wherein the clamp is a vice grip, the device having the release bar.

7. A method for consolidating grout within a cell of a masonry block via a reinforcement bar, the bar having a first portion and a second portion, the first portion extending vertically through the cell, the second portion extending above the block outside the cell, the method comprising:

handling a device including a first arm having a first handle and a second arm having a second handle, the first arm pivotally coupled to the second arm, at least one of the first arm and the second arm coupled to a vibrator, the device including a spring coupled to the first handle and the second handle to bias the first arm and the second arm, the first arm including a first wall and the second arm including a second wall, the first wall and the second wall form a bi-open ended cylinder when the spring is expanded, the first wall and the second wall avoid forming the cylinder when the first handle and the second handle are squeezed together and the spring is compressed, the cylinder operative to receive the second portion such that the second portion extends through the cylinder along the walls to protrude from both open ends of the cylinder, the vibrator operative to selectively produce vibration for communication through the cylinder from the second portion to the first portion, the vibration for consolidating the grout surrounding the first portion within the cell to substantially eliminate gaps and voids therein;

securing the cylinder to the second portion such that the second portion extends through the cylinder along the walls to protrude from both of the open ends; and activating the vibrator to vibrate the second portion via the cylinder for consolidating the grout surrounding the first portion.

8. The method of claim 7, wherein the securing comprising opening the cylinder via compressing the spring and then closing the cylinder around the second portion via expanding the spring.

9. The method of claim 7, wherein the securing comprising pivoting the first arm with respect to the second arm.

10. A method for consolidating grout via a reinforcing bar that extends through grout, the method comprising:

handling a device including clamp which engages the bar, the clamp including a bar sleeve operative to extend around the bar, the sleeve having a pair of open ends allowing the bar to extend through the sleeve and protrude from both of the open ends, the sleeve having a first part and a second part that together form a cylindrical tube having a proximal end and a distal end, the pair of open ends are the proximal end and the distal end, the clamp including a spring and a first arm pivotally attached to a second arm, the spring coupled to the first arm and the second arm, the first arm attached to the first part of the sleeve and the second arm attached to the second part of the sleeve, the clamp having an open position and a closed position, the clamp including a clamping mechanism connected to the first arm and second arm, the clamping mechanism providing a mechanism for opening and closing the clamp, the device including a vibration source attached to the clamp, the source selectively producing vibration for communication through the sleeve to the bar to consolidate the grout surrounding the bar and substantially eliminate gaps and voids therein;

securing the clamp to the bar by extending the bar through the sleeve through the open ends; and consolidating the grout around the bar by vibrating the bar via generation of vibration through the sleeve by the source.

11. The method of claim 10, wherein the spring is compressed at the closed position.

12. The method of claim 11, wherein the clamping mechanism is a vice grip having a first handle rigidly attached to the first arm, a second handle pivotally attached to the second arm and a main pivot point at which the first arm and second arm are pivotally attached.

13. The method of claim 12, wherein the device including a connecting arm attached between the first handle and second handle for adjusting a distance between the first arm and second arm and for urging the clamp into the open position.

14. The method of claim 13, wherein the device including a release bar attached to the second handle for urging the second arm to open the clamp, the spring connected between the first handle and the second handle.

* * * * *